US010640859B2

(12) United States Patent
Kimijima et al.

(10) Patent No.: US 10,640,859 B2
(45) Date of Patent: May 5, 2020

(54) PRODUCTION METHOD OF ROLLED SHEET FOR COLD-ROLLING, AND PRODUCTION METHOD OF PURE TITANIUM SHEET

(71) Applicant: Kobe Steel, Ltd., Kobe-shi (JP)

(72) Inventors: Kazuya Kimijima, Hyogo (JP); Masanori Kobayashi, Hyogo (JP); Tohru Shiogama, Hyogo (JP); Keitaro Tamura, Hyogo (JP); Yasuyuki Fujii, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 15/558,043

(22) PCT Filed: Mar. 16, 2016

(86) PCT No.: PCT/JP2016/058330
§ 371 (c)(1),
(2) Date: Sep. 13, 2017

(87) PCT Pub. No.: WO2016/152678
PCT Pub. Date: Sep. 29, 2016

(65) Prior Publication Data

US 2018/0298479 A1 Oct. 18, 2018

(30) Foreign Application Priority Data

Mar. 25, 2015 (JP) ..... 2015-063256

(51) Int. Cl.
*C22C 14/00* (2006.01)
*C22F 1/18* (2006.01)
(Continued)

(52) U.S. Cl.
CPC ..... *C22F 1/183* (2013.01); *B21B 1/22* (2013.01); *B21B 3/00* (2013.01); *C22C 14/00* (2013.01); *C22F 1/18* (2013.01); *B21B 2001/225* (2013.01)

(58) Field of Classification Search
CPC ... C22F 1/18; C22F 1/183; B21B 1/22; B21B 3/00; C22C 14/00
(Continued)

(56) References Cited

U.S. PATENT DOCUMENTS

2013/0164166 A1* 6/2013 Shirai ..... C22C 14/00 420/417

FOREIGN PATENT DOCUMENTS

JP 57-108252 A 7/1982
JP 59-41508 B2 10/1984
(Continued)

*Primary Examiner* — Brian D Walck
(74) *Attorney, Agent, or Firm* — Oblon, McClelland, Maier & Neustadt, L.L.P.

(57) ABSTRACT

An aspect of the present invention is a production method of a rolled sheet for cold-rolling, the method being characterized by including: a hot-rolling step for forming a rolled sheet by hot-rolling a pure titanium material while coiling; and an annealing step for annealing the hot-rolled sheet after the hot-rolling step, the coiling temperature in the hot-rolling step being 500° C. or less, and the annealing step being controlled so that the percentage area of recrystallized grains in the microstructure of the hot-rolled sheet after annealing is at least 90% and the mean grain size of the recrystallized grains is 5 μm to 10 μm.

3 Claims, 2 Drawing Sheets

(51) Int. Cl.
*B21B 3/00* (2006.01)
*B21B 1/22* (2006.01)

(58) Field of Classification Search
USPC ..... 148/670, 671
See application file for complete search history.

(56) References Cited

FOREIGN PATENT DOCUMENTS

| | | | |
|---|---|---|---|
| JP | 8-67955 | A | 3/1996 |
| JP | 2013-181246 | A | 9/2013 |

* cited by examiner

PRODUCTION METHOD OF ROLLED SHEET FOR COLD-ROLLING, AND PRODUCTION METHOD OF PURE TITANIUM SHEET

TECHNICAL FIELD

The present invention relates to a production method of a rolled sheet for cold-rolling, and to a production method of a pure titanium sheet.

BACKGROUND ART

A cold-rolling process has been known as a production process of a commercially pure titanium sheet, the process being capable of providing a product with high accuracy that inhibits surface oxidization and thermal contraction. The cold-rolling process typically comprises a hot-rolling step, an annealing step, a first cold-rolling step, an intermediate annealing step, a second cold-rolling step, and a finishing annealing step. In the cold-rolling process: a rolled body is formed by the hot-rolling step and the annealing step; in the first cold-rolling step, the rolled body is rolled to form a rolled sheet having an intermediate thickness; and the rolled sheet is subjected to the intermediate annealing step and then again to the cold-rolling (second cold-rolling step), whereby a rolled sheet having a product thickness is formed. In other words, in the cold-rolling process, the cold-rolling step and the annealing step are repeated to gradually thin the rolled sheet. Furthermore, in such a cold-rolling process, a total rolling reduction (rolling reduction being a percentage reduction in thickness after rolling) is small in each of the first cold-rolling step and the second cold-rolling step in order to prevent a crack and a rupture of the rolled sheet.

On the other hand, in these days, an increasing demand for commercially pure titanium sheets and an increasing emphasis on reduction of production cost, etc. have been accompanied by a need for omission of steps.

With regard to the omission of steps, for example, omission of the first cold-rolling step and the intermediate annealing step is under study. However, omitting the first cold-rolling step and the intermediate annealing step requires a large increase in the total rolling reduction in the second cold-rolling step. Consequently, such a conventional process is unable to maintain sufficient ductility of the rolled sheet during the cold-rolling in the second cold-rolling step, whereby an edge crack and a rupture of the rolled sheet may be generated during the cold-rolling.

In this regard, as a measure for preventing such an edge crack and a rupture, the thickness of the rolled sheet formed by the hot-rolling step may be reduced to decrease the total rolling reduction in the second cold-rolling step. However, such a measure may cause a rolling failure in the hot-rolling step and may lower a pickling yield in the annealing step following the hot-rolling step.

A technique of omitting steps alternative to the omission of the first cold-rolling step and the intermediate annealing step (technique of omitting steps other than the first cold-rolling step and the intermediate annealing step) is exemplified by techniques disclosed in Patent Documents 1 and 2.

Patent Document 1 discloses a production method of a high-strength pure titanium sheet comprising hot-rolling in one direction at a heating temperature of greater than or equal to 840° C. and less than 920° C. to attain a rolling reduction of greater than or equal to 95%, without being followed by the annealing.

Patent Document 2 discloses a production method of a hot-rolled titanium sheet comprising: forcedly cooling a hot-rolled titanium sheet; and then coiling the sheet at a temperature of less than or equal to 500° C. It is disclosed that the method enables the hot-rolled titanium sheet to serve as a material for cold-rolling as is, without annealing. In other words, in the production method of a titanium sheet proposed in Patent Document 2, the annealing step between the hot-rolling step and the first cold-rolling step can be omitted. Furthermore, the production method enables a product quality to be uniform without the annealing step, due to subjecting the hot-rolled titanium sheet to quenching and then to the coiling at the temperature not causing grain growth.

PRIOR ART DOCUMENTS

Patent Documents

Patent Document 1: Japanese Unexamined Patent Application, Publication No. 2013-181246

Patent Document 2: Japanese Unexamined Patent Application, Publication No. S57-108252

SUMMARY OF THE INVENTION

Problems to be Solved by the Invention

An object of the present invention is to provide a production method of a rolled sheet for cold-rolling that is capable of sufficiently inhibiting generation of an edge crack during the cold-rolling even without the intermediate annealing step carried out between the cold-rolling steps, and a production method of a pure titanium sheet.

Means for Solving the Problems

In an aspect of the present invention, a production method of a rolled sheet for cold-rolling comprises: hot-rolling a pure titanium material while coiling; and annealing a hot-rolled sheet formed by the hot-rolling, wherein a coiling temperature in the hot-rolling is less than or equal to 500° C., and the annealing is controlled such that a percentage area of recrystallized grains in a microstructure of the hot-rolled sheet after the annealing is greater than or equal to 90%, and that a mean grain diameter of the recrystallized grains is greater than or equal to 5 μm and less than or equal to 10 μm.

The aforementioned and other objects, features, and advantages of the present invention will be elucidated by the following detailed description and the accompanying drawings.

DESCRIPTION OF EMBODIMENTS

Figure 1:
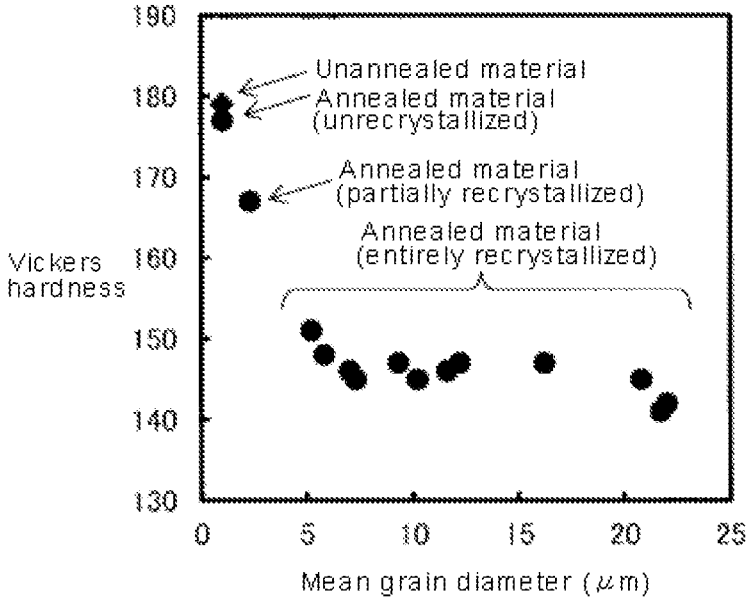
FIG. 1 is a chart showing a relationship of a mean grain diameter of crystal grains and recrystallized grains in a microstructure of a hot-rolled sheet after the annealing, with a Vickers hardness of the rolled sheet.

In the production method disclosed in Patent Document 1, due to the high heating temperature in the hot-rolling step, a relatively thick oxidized layer is likely to be formed on a surface of the rolled sheet by the heating. Consequently, the production method is highly likely to cause flaws on the surface of the rolled sheet. In addition, the production method may cause the edge crack during the cold-rolling, due to insufficient ductility of the rolled sheet resulting from absence of the annealing subsequent to the hot-rolling step.

Meanwhile, in the production method disclosed in Patent Document 2, quenching the titanium sheet after the hot-rolling results in an extremely small crystal grain diameter in the microstructure of the titanium sheet. Thus, the production method does not provide a sufficiently ductile titanium sheet. Subjecting such a titanium sheet directly to the cold-rolling without carrying out annealing may therefore result in formation of cracks at both edges.

The present inventors have found that an adjustment of conditions for the hot-rolling step and the annealing step influences the generation of the edge crack during the cold-rolling step carried out thereafter.

Accordingly, the present inventors have focused on omission of the intermediate annealing step between the first cold-rolling step and the second cold-rolling step (the intermediate annealing step between the cold-rolling steps) for the reduction of production cost, thereby conceiving of the present invention described below.

The embodiments of the present invention will be described hereinafter; however, the present invention is not in any way limited thereto.

A production method of a rolled sheet for cold-rolling according to an embodiment of the present invention comprises: a hot-rolling step of hot-rolling a pure titanium material while coiling; and an annealing step of annealing a hot-rolled sheet formed by the hot-rolling step. A coiling temperature in the hot-rolling step is less than or equal to 500° C. In addition, the annealing step is controlled such that a percentage area of recrystallized grains in a microstructure of the hot-rolled sheet after the annealing is greater than or equal to 90%, and that a mean grain diameter of the recrystallized grains is greater than or equal to 5 μm and less than or equal to 10 μm.

Such a production method enables a rolled sheet for cold-rolling to be produced that is capable of sufficiently inhibiting generation of the edge crack during the cold-rolling, even without the intermediate annealing step carried out between the cold-rolling steps. In other words, the production method of the present embodiment enables a rolled sheet for cold-rolling to be produced that is capable of reducing the production cost while inhibiting the generation of the edge crack during the cold-rolling.

The reason for the production method of the present embodiment achieving the aforementioned effect is inferred as in the following. In the hot-rolling step, due to the temperature at which the hot-rolled sheet is coiled (coiling temperature) falling within the aforementioned range, the crystal grains in the microstructure of the rolled sheet formed by the hot-rolling step are likely to have small and substantially the same diameter. Consequently, the production method of a rolled sheet for cold-rolling is capable of readily controlling the percentage area and the mean grain diameter of the recrystallized grains in the microstructure of the hot-rolled sheet after the annealing so as to fall within the aforementioned ranges.

It is to be noted that, according to conventional findings, making the crystal grain diameter as large as possible in the annealing step carried out prior to the cold-rolling is reportedly preferred.

Whereas, the present inventors have found that a smaller crystal grain diameter results in increased crystal grain boundaries which inhibit generation of the edge crack of the rolled sheet during the cold-rolling. Although the reason for the achievement of the aforementioned effect is not clarified, it can be inferred that fine cracks caused by the crystal grain boundaries would be an obstacle to propagation of the cracks to an inner part of the rolled sheet during the cold-rolling. As a result, due to the percentage area and the mean grain diameter of the recrystallized grains in the microstructure of the hot-rolled sheet after the annealing falling within the aforementioned ranges, the production method of a rolled sheet for cold-rolling enables the rolled sheet to have sufficient ductility during the cold-rolling, and to appropriately prevent the generation of the edge crack during the cold-rolling. Therefore, the production method of a rolled sheet for cold-rolling enables the production of the rolled sheet for cold-rolling that is capable of sufficiently inhibiting the generation of the edge crack during the cold-rolling, even without the intermediate annealing step carried out between the cold-rolling steps. In other words, carrying out the cold-rolling without the conventional intermediate annealing step enables the reduction of production cost while inhibiting the generation of the edge crack of the rolled sheet during the cold-rolling.

A production method of a pure titanium sheet according to another embodiment of the present invention comprises a cold-rolling step of cold-rolling a rolled sheet for cold-rolling obtained by the aforementioned production method of a rolled sheet for cold-rolling, without intermediate annealing. In other words, the production method of a pure titanium sheet comprises the hot-rolling step, the annealing step, and the cold-rolling step.

Such a production method provides a pure titanium sheet with satisfactorily inhibited generation of the edge crack during the cold-rolling in the cold-rolling step even without carrying out the intermediate annealing step. The production method of a pure titanium sheet enables easy and reliable production of the pure titanium sheet with the inhibited generation of the edge crack during the cold-rolling, by cold-rolling the rolled sheet for cold-rolling (rolled sheet obtained by the annealing step), without carrying out the intermediate annealing. As in the aforementioned conventional production method, in the case of omitting the annealing step between the hot-rolling step and the first cold-rolling step, a pickling treatment is required in order to remove the oxidized layer formed on the surface of the rolled sheet through the hot-rolling step. Whereas, in the case of omitting the intermediate annealing step, the pickling treatment subsequent to the intermediate annealing can similarly be omitted since the oxidized layer would not be formed. Therefore, the production method of a pure titanium sheet achieves a cost reduction effect superior to that of the conventional production method.

It is to be noted that, since the production method of a rolled sheet for cold-rolling is a part of the production method of a pure titanium sheet of this embodiment as described above, the production method of a pure titanium sheet will be described hereinafter.

The production method of a pure titanium sheet is employed as a production method of a pure titanium sheet by the cold-rolling process. The production method of a pure titanium sheet comprises the hot-rolling step, the annealing step, and the cold-rolling step. The production method of a rolled sheet for cold-rolling comprises, of these, the hot-rolling step and the annealing step.

Hot-Rolling Step

In the hot-rolling step, first, a pure titanium material is hot-rolled. A pure titanium material having a larger grade number is less expensive. Meanwhile, hardness of the pure titanium material increases with the grade number, due to increases in contents of Fe, O, etc. resulting in superior solid-solution strengthening performance. Therefore, a pure titanium material having a larger grade number has lower ductility, and in turn, is more likely to be accompanied by generation of the edge crack during the cold-rolling. In this respect, the production method of a pure titanium sheet according to the present embodiment is capable of inhibiting generation of the edge crack during the cold-rolling, even in a case of using a pure titanium material of Grade 2 or higher which is relatively hard. Accordingly, relatively inexpensive pure titanium materials other than those of Grade 1 can be used. Of these, pure titanium materials of Grade 2 are particularly preferred, from the perspective that appropriate prevention of generation of the edge crack during the cold-rolling is enabled.

It is to be noted that the term "pure titanium material" as referred to herein means a pure titanium material that falls under any one of Grades 1 to 4 as prescribed in JIS-H4600 (1964), encompassing those containing minute amounts of impurities such as Fe and O.

In the hot-rolling step, first, a slab of the pure titanium material is heated in a heating furnace. The lower limit of a heating temperature is preferably 750° C. and more preferably 780° C. Meanwhile, the upper limit of the heating temperature is preferably 830° C. and more preferably 810° C. When the heating temperature is lower than the lower limit, the slab may not be sufficiently softened and may be resistant to rolling. On the other hand, when the heating temperature is higher than the upper limit, the oxidized layer formed on a surface of the slab may become thick, leading to generation of surface flaws during rolling.

Subsequently in the hot-rolling step, the slab thus heated is subjected to rough rolling at the heating temperature, and then to finishing rolling. The lower limit of a finishing rolling temperature is preferably 650° C. and more preferably 670° C. Meanwhile, the upper limit of the finishing rolling temperature is preferably 750° C. and more preferably 730° C. When the finishing rolling temperature is lower than the lower limit, a rolled sheet may not be sufficiently softened and may be resistant to rolling. To the contrary, when the finishing rolling temperature is higher than the upper limit, the oxidized layer formed on a surface of the rolled sheet may become so thick that the surface flaws during rolling may be generated. It is to be noted that, as a rough rolling mill used in the rough rolling and a finishing rolling mill used in the finishing rolling, well-known multi-high rolling mills can be used.

An average thickness of the rolled sheet after the finishing rolling may be, for example, greater than or equal to 3 mm and less than or equal to 4 mm. When the average thickness of the rolled sheet after the finishing rolling is less than the lower limit, a rolling failure may be caused in the hot-rolling step. Furthermore, the pickling yield in the annealing step (described later) may be lowered. On the other hand, when the average thickness of the rolled sheet after the finishing rolling is greater than the upper limit, it may be difficult to sufficiently thin the pure titanium sheet obtained by the aforementioned production method of a pure titanium sheet.

Subsequently in the hot-rolling step, the rolled sheet formed by the finishing rolling is cooled and coiled. The rolled sheet thus formed by the hot-rolling step is a hot-rolled coil.

In the hot-rolling step, the lower limit of a cooling rate at which the rolled sheet is cooled prior to the coiling is preferably 20° C./sec and more preferably 50° C./sec. When the cooling rate is lower than the lower limit, a cooling time period may be prolonged to result in generation of coarse crystal grains in the rolled sheet, in turn generation of the edge crack during the cold-rolling (described later). It is to be noted that the upper limit of the cooling rate is not particularly limited since the cooling rate is preferably as high as possible; however, the upper limit may be, for example, 200° C./sec. A type of the cooling may be, for example, water cooling.

The upper limit of a temperature at which the hot-rolled sheet is thereafter coiled (coiling temperature of the hot-rolled coil) is preferably 500° C., more preferably 450° C., and still more preferably 400° C. When the coiling temperature of the hot-rolled coil is greater than the upper limit, the microstructure of the rolled sheet may undergo recrystallization and coarsening after the coiling, whereby recrystallization of the microstructure of the rolled sheet in the annealing step (described later) may be difficult, or, even if recrystallization takes place, further coarsening of the grains may occur. It is to be noted that the lower limit of the coiling temperature of the hot-rolled coil is not particularly limited because the lower coiling temperature serves in promoting formation of a uniform microstructure of the rolled sheet; however, in view of preventing the prolonged cooling time, the lower limit may be, for example, 100° C.

The microstructure of the hot-rolled sheet after the coiling preferably does not undergo recrystallization. The upper limit of the percentage area of the recrystallized grains in the microstructure of the hot-rolled sheet after the coiling is preferably 5%, more preferably 3%, and still more preferably 1%. When the percentage area of the recrystallized grains in the microstructure of the hot-rolled sheet after the coiling is greater than the upper limit, the grains after the annealing may be coarse. It is to be noted that the percentage area of the recrystallized grains in the microstructure of the hot-rolled sheet after the coiling is preferably as low as possible, and therefore the lower limit thereof may be 0%.

The term "percentage area of recrystallized grains in a microstructure" as referred to herein means a ratio of an area of the recrystallized grains to an area of the entire microstructure observed by using a scanning electron microscope (SEM) (area of recrystallized grains/area of entire microstructure).

The upper limit of a mean grain diameter of crystal grains in the microstructure of the hot-rolled sheet after the coiling is preferably 5 μm and more preferably 3 μm. When the mean grain diameter of crystal grains in the microstructure of the hot-rolled sheet after the coiling is greater than the upper limit, the recrystallized grains after the annealing may be coarse. It is to be noted that the lower limit of the mean grain diameter of the crystal grains in the microstructure of the hot-rolled sheet after the coiling is not particularly limited, and may be, for example, 0.5 μm.

The term "mean grain diameter" as referred to herein means an average of equivalent perfect circle diameters of a plurality of grains observed in a field of view by using a scanning electron microscope (SEM).

Annealing Step

In the annealing step, the rolled sheet after the hot-rolling step is annealed. The annealing is controlled such that a percentage area of recrystallized grains in a microstructure of the rolled sheet after the annealing is greater than or equal to 90%, and that a mean grain diameter of the recrystallized grains is greater than or equal to 5 μm and less than or equal to 10 μm. The annealing step comprises: raising a temperature of the rolled sheet after the hot-rolling step; and maintaining a temperature-raised state in the raising (finally elevated temperature in the raising of temperature, may be merely referred to as "elevated temperature" or "elevated temperature T"). It is preferred to use a continuous annealing furnace in the annealing step, since annealing in a relatively short period of time is required as described later. A heating system of the annealing furnace is not particularly limited and, for example, a direct-fired furnace can be used.

Raising of Temperature

The temperature of the hot-rolled sheet after the coiling (after the hot-rolling step) is preferably raised to fall within a range of greater than or equal to 650° C. and less than or equal to 750° C. The lower limit of the elevated temperature is more preferably 670° C. Meanwhile, the upper limit of the elevated temperature is more preferably 730° C. According to the production method of a pure titanium sheet, strain caused in the rolled sheet during the rough rolling and the finishing rolling is corrected almost completely before the coiling. As a result, the strain due to the rolling hardly persists in the microstructure of the hot-rolled sheet after the coiling. Therefore, when the elevated temperature of the hot-rolled sheet is less than the lower limit, crystals in the microstructure may not be recrystallized. On the other hand, when the elevated temperature is greater than the upper limit, the grain diameters of the recrystallized grains in the microstructure of the hot-rolled sheet after the annealing may be too large. It is to be noted that the temperature in the raising is a value obtained by measuring a temperature of the rolled sheet.

Maintaining of Temperature

After the raising of the temperature, the hot-rolled sheet is maintained in the temperature-raised state. In other words, the hot-rolled sheet after the raising is maintained at the elevated temperature in the raising of the temperature. In a case in which the elevated temperature T (° C.) is greater than or equal to 650° C. and less than 680° C., a duration t (sec) of the maintaining is preferably greater than or equal to 160 sec and less than or equal to 200 sec, and more preferably greater than 160 sec and less than or equal to 200 sec. In a case in which the elevated temperature (° C.) is greater than or equal to 680° C. and less than 720° C., the duration t (sec) of the maintaining is preferably greater than or equal to 80 sec and less than or equal to 160 sec. In a case in which the elevated temperature (° C.) is greater than 720° C. and less than or equal to 750° C., the duration t (sec) of the maintaining is preferably greater than or equal to 40 sec and less than or qual to 80 sec, and more preferably greater than or equal to 40 sec and less than 80 sec. In other words, the duration t (sec) in the maintaining is preferably as defined in any one of (1) to (3), and more preferably as defined in (2), (4) or (5).

(1) 160 sec≤t≤200 sec in a case of 650° C.≤T<680° C.;

(2) 80 sec≤t≤160 sec in a case of 680° C.<T≤720° C.;

(3) 40 sec≤t≤80 sec in a case of 720° C.<T≤750° C.;

(4) 160 sec<t≤200 sec in a case of 650° C.≤T<680° C.; and (5) 40 sec≤t<80 sec in a case of 720° C.<T≤750° C.

It is to be noted that T represents the elevated temperature (° C.).

When the duration t in the maintaining is less than the lower limit, the crystals in the microstructure of the hot-rolled sheet formed by the hot-rolling step may not be recrystallized. On the other hand, when the duration t in the maintaining is greater than the upper limit, the grain diameters of the recrystallized grains in the microstructure of the hot-rolled sheet after the annealing may be too large. Whereas, the production method of a pure titanium sheet enables the percentage area and the mean grain diameter of the recrystallized grains in the microstructure of the hot-rolled sheet to be controlled to fall within the aforementioned ranges, due to, in the annealing step, raising the temperature of the hot-rolled sheet to fall within the aforementioned range and maintaining the hot-rolled sheet after the raising at the aforementioned temperature for the aforementioned duration. In particular, the elevated temperature T and the duration t in the maintaining are particularly preferably as defined in (2). When the elevated temperature T in the raising is greater than or equal to 680° C. and less than or equal to 720° C., the duration t in the maintaining can be adjusted within a relatively broad range. It is to be noted that, in the maintaining, the temperature of the hot-rolled sheet is maintained preferably in a range as defined above in any one of (1) to (3), and more preferably in a range as defined above in (2), (4) or (5), on the basis of the elevated temperature. Accordingly, it is preferred that, in the maintaining, the temperature of the hot-rolled sheet is controlled at an outlet or immediately after the outlet of the annealing furnace where the temperature of the hot-rolled sheet is likely to be highest. A measurement process of the temperature of the hot-rolled sheet is not particularly limited; however, a radiation thermometer, which enables a highly accurate temperature measurement over the full length of the hot-rolled sheet after the coiling, is preferably used.

The lower limit of the percentage area of the recrystallized grains in the microstructure after the annealing is more preferably 95%, still more preferably 98%, and particularly preferably 100%. When the percentage area of the recrystallized grains in the microstructure after the annealing falls within the aforementioned range, easy and reliable prevention of generation of the edge crack during the cold-rolling is enabled. It is to be noted that the percentage area of the recrystallized grains in the microstructure after the annealing is preferably as high as possible, and therefore the upper limit thereof may be 100%.

The lower limit of the mean grain diameter of the recrystallized grains in the microstructure after the annealing is more preferably 6 μm. Meanwhile, the upper limit of the mean grain diameter of the recrystallized grains in the microstructure after the annealing is more preferably 8 μm. When the mean grain diameter of the recrystallized grains in the microstructure after the annealing falls within the aforementioned range, easy and reliable prevention of generation of the edge crack during the cold-rolling is enabled.

The production method of a pure titanium sheet preferably comprises, subsequently to the annealing step, a pickling step of removing an oxidized layer formed on the surface of the rolled sheet during the hot-rolling step and the annealing step. The oxidized layer can be removed by using, for example, a descaler.

Figure 2:
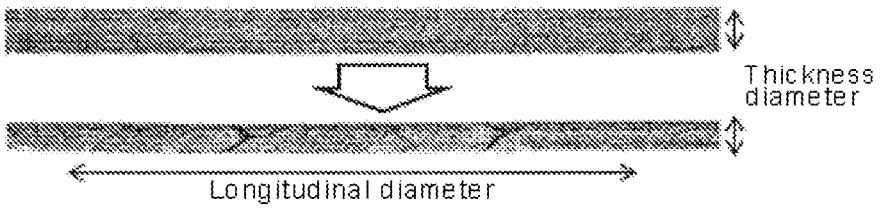
FIG. 2 is a micrograph showing edge cracks of a rolled sheet generated during cold-rolling.

Relationship of Mean Grain Diameter of Crystal Grains and Recrystallized Grains in Microstructure of Hot-Rolled Sheet with Hardness of Rolled Sheet With reference to FIG. 1, a relationship of the mean grain diameter of the crystal grains and the recrystallized grains in the microstructure after the annealing with the hardness of the rolled sheet is now described. As shown in FIG. 1, in a case in which no annealing follows the hot-rolling step ("Unannealed material" in FIG. 1), and in a case in which the annealing follows the hot-rolling step but the microstructure after the annealing is not recrystallized ("Annealed material (unrecrystallized)"), the mean grain diameter of the crystal grains remains unchanged from the mean grain diameter after the hot-rolling step. Thus, due to the small mean grain diameter of the crystal grains, the rolled sheet has an extremely high Vickers hardness. Consequently, cold-rolling of such a rolled sheet results in generation of the edge crack as shown in FIG. 2, due to the low ductility of the rolled sheet (it is to be noted that in FIG. 2 an upper part shows the rolled sheet prior to the cold-rolling and a lower part shows the rolled sheet after the cold-rolling). In addition, in a case in which the percentage area of the recrystallized grains in the microstructure after the annealing is small ("Annealed material (partially recrystallized)" in FIG. 1), the Vickers hardness is not sufficiently low. Consequently, cold-rolling of such a rolled sheet results in generation of the edge crack.

Whereas, in a case in which the crystal grains in the microstructure after the annealing are entirely recrystallized ("Annealed material (entirely recrystallized)" in FIG. 1), the Vickers hardness is maintained at an almost constant low level regardless of the mean grain diameter of the recrystallized grains. Consequently, the rolled sheet has sufficient ductility, whereby generation of the edge crack during cold-rolling is inhibited.

It is to be noted that the term "Vickers hardness" as referred to means a value measured pursuant to "Vickers hardness test—Test method" prescribed in JIS-Z2244 (2009), with a test force of 9.8 N.

Cold-Rolling Step

In the cold-rolling step, the rolled sheet obtained by the annealing step (rolled sheet for cold-rolling) is cold-rolled. The cold-rolling step does not comprise the intermediate annealing. The total rolling reduction in the cold-rolling step is preferably greater than 85%. In other words, it is preferred that in the cold-rolling step no intermediate annealing is carried out and that the total rolling reduction is greater than 85%. Since the rolled sheet for cold-rolling obtained by the production method of a rolled sheet for cold-rolling (rolled sheet obtained by the annealing step) is capable of inhibiting generation of the edge crack during the cold-rolling even without the intermediate annealing step carried out between the cold-rolling steps, it is preferred that in the cold-rolling step no intermediate annealing is carried out and the cold-rolling is carried out such that the total rolling reduction is greater than 85%.

It is to be noted that a well-known rolling mill, for example a reversing rolling mill in which repeated rolling is carried out by a single mill, can be used for the cold-rolling.

The lower limit of the total rolling reduction in the cold-rolling step is more preferably 86% and still more preferably 88%. When the total rolling reduction in the cold-rolling step falls within the aforementioned range, prevention of the edge crack of the pure titanium sheet to be obtained is enabled, while the pure titanium sheet is sufficiently thinned. The upper limit of the total rolling reduction in the cold-rolling step is not particularly limited; however, the upper limit may be, for example, 90% in light of prevention of the edge crack of the pure titanium sheet to be obtained.

An average thickness of the pure titanium sheet formed by the cold-rolling step is preferably less than 1 mm. Meanwhile, the upper limit of the average thickness of the pure titanium sheet formed by the cold-rolling step is more preferably 0.8 mm. The production method of a pure titanium sheet enables prevention of the edge crack of the pure titanium sheet, even when the pure titanium sheet is sufficiently thinned such that the average thickness falls within the aforementioned range. The lower limit of the average thickness of the pure titanium sheet formed by the cold-rolling step is not particularly limited; however, the lower limit may be, for example, 0.5 mm.

Advantages

In the production method of a rolled sheet for cold-rolling, due to the coiling temperature of the hot-rolled coil in the hot-rolling step falling within the aforementioned range, the crystal grains in the microstructure of the rolled sheet formed by the hot-rolling step are likely to have small and substantially the same diameter. Consequently, the production method of a rolled sheet for cold-rolling is capable of readily controlling the percentage area and the mean grain diameter of the recrystallized grains in the microstructure of the hot-rolled sheet after the annealing so as to fall within the aforementioned ranges.

It is to be noted that, according to conventional findings, making the crystal grain diameter as large as possible in the annealing step carried out prior to the cold-rolling is reportedly preferred.

Whereas, the present inventors have found that a smaller crystal grain diameter results in increased crystal grain boundaries which inhibit generation of the edge crack of the rolled sheet during the cold-rolling. Although the reason for the achievement of the aforementioned effect is not clarified, it can be inferred that fine cracks caused by the crystal grain boundaries would be an obstacle to propagation of the cracks to an inner part of the rolled sheet during the cold-rolling. As a result, due to the percentage area and the mean grain diameter of the recrystallized grains in the microstructure of the hot-rolled sheet after the annealing falling within the aforementioned ranges, the production method of a rolled sheet for cold-rolling enables the rolled sheet to have sufficient ductility during the cold-rolling, and to appropriately prevent the generation of the edge crack during the cold-rolling. Therefore, the production method of a rolled sheet for cold-rolling enables the production of the rolled sheet for cold-rolling that is capable of sufficiently inhibiting the generation of the edge crack during the cold-rolling, even without the conventional intermediate annealing step (intermediate annealing step carried out between the cold-rolling steps). In other words, according to the production method of a rolled sheet for cold-rolling, carrying out the cold-rolling without the conventional intermediate annealing step enables the reduction of production cost while inhibiting the generation of the edge crack of the rolled sheet during the cold-rolling.

The production method of a pure titanium sheet employs the production method of a rolled sheet for cold-rolling. The production method of a pure titanium sheet subjects the rolled sheet for cold-rolling obtained by the production method of a rolled sheet for cold-rolling (rolled sheet obtained by the annealing step) to the cold-rolling, without carrying out the intermediate annealing. The production method of a pure titanium sheet thus enables easy and reliable production of the pure titanium sheet in which formation of the edge crack has been inhibited during the cold-rolling. As in the aforementioned conventional production method, in the case of omitting the annealing step between the hot-rolling step and the first cold-rolling step, a pickling treatment is required in order to remove the oxidized layer formed on the surface of the rolled sheet through the hot-rolling step. Whereas, in the case of omitting the intermediate annealing step, the pickling treatment subsequent to the intermediate annealing may similarly be omitted since the oxidized layer would not be formed. Therefore, the production method of a pure titanium sheet achieves a cost reduction effect superior to that of the conventional production method.

For example, in a case of using a pure titanium material of Grade 1 that is relatively high in ductility, the production method of a pure titanium sheet is capable of sufficiently thinning a pure titanium sheet to be obtained even when the average thickness of the rolled sheet after the finishing rolling is relatively great, due to the total rolling reduction in the cold-rolling step being increased. Furthermore, in the production method of a pure titanium sheet, by trimming the coiled rolled sheet to thereby remove irregularities at ends of the rolled sheet, formation of the edge crack during the cold-rolling is more likely to be inhibited than in a case of not carrying out the trimming. The trimming preferably precedes the annealing step.

Various modes of techniques have been disclosed herein. Of these, principal techniques will be summarized hereinafter.

In an aspect of the present invention, a production method of a rolled sheet for cold-rolling comprises: a hot-rolling step of hot-rolling a pure titanium material while coiling to form a hot-rolled sheet; and an annealing step of annealing the hot-rolled sheet after the hot-rolling step, wherein a coiling temperature in the hot-rolling step is less than or equal to 500° C., and the annealing step is controlled such that a percentage area of recrystallized grains in a microstructure of the hot-rolled sheet obtained after the annealing is greater than or equal to 90%, and that a mean grain diameter of the recrystallized grains is greater than or equal to 5 μm and less than or equal to 10 μm.

In the production method of a rolled sheet for cold-rolling, due to the coiling temperature of the hot-rolled coil in the hot-rolling step falling within the aforementioned range, the crystal grains in the microstructure of the hot-rolled sheet formed by the hot-rolling step are likely to have small and substantially the same diameter. Consequently, the production method of a rolled sheet for cold-rolling is capable of readily controlling the percentage area and the mean grain diameter of the recrystallized grains in the microstructure of the hot-rolled sheet after the annealing to fall within the aforementioned ranges. It is to be noted that, according to conventional findings, making the crystal grain diameter as large as possible in the annealing step carried out prior to the cold-rolling is reportedly preferred. Whereas, the present inventors have found that smaller crystal grain diameter results in increased crystal grain boundaries which inhibit generation of the edge crack of the rolled sheet during the cold-rolling. Although the reason for the achievement of the aforementioned effect is not clarified, it can be inferred that fine cracks caused by the crystal grain boundaries would be an obstacle to propagation of the cracks to an inner part of the rolled sheet during the cold-rolling. As a result, due to the percentage area and the mean grain diameter of the recrystallized grains in the microstructure of the hot-rolled sheet after the annealing falling within the aforementioned ranges, the production method of a rolled sheet for cold-rolling enables the rolled sheet to have sufficient ductility during the cold-rolling, and to appropriately prevent the generation of the edge crack during the cold-rolling. Therefore, the production method of a rolled sheet for cold-rolling enables the production of the rolled sheet for cold-rolling that is capable of sufficiently inhibiting the generation of the edge crack during the cold-rolling, even without the conventional intermediate annealing step (intermediate annealing step carried out between the cold-rolling steps). In other words, according to the production method of a rolled sheet for cold-rolling, carrying out the cold-rolling without the conventional intermediate annealing enables the reduction of production cost while inhibiting the generation of the edge crack of the rolled sheet during the cold-rolling.

In addition, in the production method of a rolled sheet for cold-rolling, it is preferred that the annealing step comprises: raising a temperature of the hot-rolled sheet formed by the hot-rolling to an elevated temperature T (° C.) falling within a range of greater than or equal to 650° C. and less than or equal to 750° C.; and maintaining the hot-rolled sheet after the raising of the temperature, at the elevated temperature T, wherein the maintaining is carried out for a duration t selected from following ranges (1) to (3) below, depending on a range of the elevated temperature T.

(1) 160 sec≤t≤200 sec in a case of 650° C.≤T<680° C.;

(2) 80 sec≤t≤160 sec in a case of 680° C.≤T≤720° C.; and (3) 40 sec≤t≤80 sec in a case of 720° C.<T≤750° C.

Accordingly, raising the temperature of the rolled sheet after the hot-rolling step to fall within the aforementioned range and then maintaining the rolled sheet after the raising at the elevated temperature for a duration in the aforementioned range, as the annealing step, enable the production of the rolled sheet for cold-rolling that is capable of sufficiently inhibiting formation of the edge crack during the cold-rolling, even without the conventional intermediate annealing step (intermediate annealing step carried out between the cold-rolling steps). The reason for achieving such an effect is inferred to be that the percentage area and the mean grain diameter of the recrystallized grains in the microstructure of the rolled sheet are enabled to be appropriately controlled.

In another aspect of the present invention, a production method of a pure titanium sheet comprises a cold-rolling step of cold-rolling a rolled sheet for cold-rolling obtained by the production method of a rolled sheet for cold-rolling, without intermediate annealing. In other words, the another aspect of the present invention is a production method of a pure titanium sheet comprising the production method of a rolled sheet for cold-rolling, further comprising a cold-rolling step of cold-rolling the rolled sheet obtained by the annealing step, in which no intermediate annealing is carried out.

The production method of a pure titanium sheet enables easy and reliable production of the pure titanium sheet in which formation of the edge crack has been inhibited during the cold-rolling, by the cold-rolling of the rolled sheet obtained by the annealing step, without carrying out the intermediate annealing. As in the aforementioned conventional production method, in the case of omitting the annealing step between the hot-rolling step and the first cold-rolling step, a pickling treatment is required in order to remove the oxidized layer formed on the surface of the rolled sheet through the hot-rolling step. Whereas, in the case of omitting the intermediate annealing step the pickling treatment subsequent to the intermediate annealing may similarly be omitted since the oxidized layer would not be formed. Therefore, the production method of a pure titanium sheet achieves a cost reduction effect superior to that of the conventional production method.

In addition, in the production method of a pure titanium sheet, the total rolling reduction in the cold-rolling step is preferably greater than 85%. Due to the percentage area and the mean grain diameter of the recrystallized grains in the microstructure after the annealing falling within the aforementioned ranges, the production method of a pure titanium sheet is capable of sufficiently inhibiting formation of the edge crack of the rolled sheet during the cold-rolling, even when the total rolling reduction in the cold-rolling step falls within the aforementioned range.

As described in the foregoing, the production method of a rolled sheet for cold-rolling and the production method of a pure titanium sheet according to the present invention are capable of reducing the production cost while inhibiting the generation of the edge crack during the cold-rolling.

EXAMPLES

Hereinafter, the embodiments of the present invention will be explained in detail by way of Examples; however, the present invention is not limited to these Examples.

A pure titanium slab prepared according to the composition shown in Table 1 was hot-rolled under the conditions shown in Table 1, whereby hot-rolled coils A and B having an average thickness of 3.6 mm were produced.

TABLE 1

| | Composition of pure titanium slab | | | | Hot-rolling conditions | | | |
|---|---|---|---|---|---|---|---|---|
| Hot-rolled coil | O (mass %) | Fe (mass %) | Balance | Grade | Heating temperature (° C.) | Finishing rolling temperature (° C.) | Coiling temperature (° C.) | Mean grain diameter (μm) |
| A | 0.101 | 0.112 | Ti + inevitable impurities | 2 | 795 | 690 | 435 | 1.4 |
| B | 0.083 | 0.097 | Ti + inevitable impurities | 2 | 810 | 705 | 620 | 14.7 |

Subsequently, the hot-rolled coils A, B were trimmed at both ends in a width direction (20 mm from each end), and then the hot-rolled coils were divided in a longitudinal direction. Thereafter, each divided piece was annealed under the conditions shown in Table 2, and then subjected to a pickling treatment to remove an oxidized layer on a surface thereof. Rolled sheets of Examples 1 to 8 and Comparative Examples 1 to 10 were thus produced. It is to be noted that the annealing was carried out in a direct-fired furnace in which a coke-oven gas (COG) burner was installed. The annealing was carried out such that a flame of the COG burner was not in contact with the rolled sheet and the temperature deviation of the rolled sheet in the width direction was minimized.

A mean grain diameter and a percentage area of recrystallized grains in a microstructure of each of the rolled sheets of Examples 1 to 8 and Comparative Examples 1 to 10 (test samples) were measured according to the following method.

After polishing the surface of each test sample, the microstructure was observed on a rolled surface, in a region of 0.5 mm×0.5 mm (in rolling direction and width direction) at each part of a superficial layer, a quarter of thickness, and a center of thickness of the coil, based on electron back-scatter diffraction patterns (EBSPs) by using a field emission scanning electron microscope (FESEM). Thus, an equivalent circle diameter of each recrystallized grain was measured, and then an average equivalent circle diameter was calculated. In addition, an area of the entire microstructure and an area of the recrystallized grains were also measured in the microstructure observation, and then a ratio of the area of the recrystallized grains to the area of the entire microstructure (area of recrystallized grains/area of entire microstructure) was calculated.

TABLE 2

| | | | | | Mean grain diameter (μm) | |
|---|---|---|---|---|---|---|
| Rolled sheet | Hot-rolled coil | Elevated temperature (° C.) | Duration of maintaining (sec) | Percentage area of recrystallized grains (%) | Recrystallized grains alone | Crystal grains and recrystallized grains |
| Example 1 | A | 650 | 160 | 96 | 5.1 | 5.2 |
| Example 2 | A | 650 | 200 | 100 | 7.4 | 7.4 |
| Example 3 | A | 680 | 80 | 97 | 5.1 | 5.2 |
| Example 4 | A | 680 | 160 | 100 | 7.2 | 7.2 |
| Example 5 | A | 720 | 80 | 98 | 6.3 | 6.3 |
| Example 6 | A | 720 | 160 | 100 | 9.6 | 9.6 |
| Example 7 | A | 750 | 40 | 94 | 5.5 | 5.6 |
| Example 8 | A | 750 | 80 | 100 | 9.8 | 9.8 |
| Comparative Example 1 | A | 630 | 200 | 8 | 4.8 | 1.5 |
| Comparative Example 2 | A | 650 | 120 | 14 | 4.9 | 1.9 |
| Comparative Example 3 | A | 680 | 50 | 9 | 4.9 | 1.6 |
| Comparative Example 4 | A | 720 | 60 | 66 | 5.0 | 3.8 |
| Comparative Example 5 | A | 720 | 180 | 100 | 11.2 | 11.2 |
| Comparative Example 6 | A | 750 | 20 | 21 | 4.9 | 2.3 |
| Comparative Example 7 | A | 750 | 100 | 100 | 11.2 | 11.2 |

TABLE 2-continued

| Rolled sheet | Hot-rolled coil | Elevated temperature (° C.) | Duration of maintaining (sec) | Percentage area of recrystallized grains (%) | Mean grain diameter (μm) Recrystallized grains alone | Mean grain diameter (μm) Crystal grains and recrystallized grains |
|---|---|---|---|---|---|---|
| Comparative Example 8 | A | 770 | 80 | 100 | 13.4 | 13.4 |
| Comparative Example 9 | B | 700 | 100 | 0 | — | 14.7 |
| Comparative Example 10 | B | 800 | 140 | 100 | 25.9 | 25.9 |

The rolled sheets of Examples and Comparative Examples were then cold-rolled by a single-stand reversing cold-rolling mill (6-high rolling mill comprising work rolls, intermediate rolls, and backup rolls; working roll diameter: 145 mm, working roll: dull finished). A target thickness of the cold-rolling was 0.50 mm (total rolling reduction: 86%). The number of passes in the cold-rolling was 21 to 25. Observation was carried out on whether an edge crack was generated by the cold-rolling before obtaining the target thickness. Also, at the same time, a lateral face of the coil was visually observed upon formation of the edge crack. The observation results are shown in Table 3.

TABLE 3

| Rolled sheet | Formation of edge crack | Upon formation of edge crack: Sheet thickness (mm) | Upon formation of edge crack: Total rolling reduction (%) |
|---|---|---|---|
| Example 1 | No | — | — |
| Example 2 | No | — | — |
| Example 3 | No | — | — |
| Example 4 | No | — | — |
| Example 5 | No | — | — |
| Example 6 | No | — | — |
| Example 7 | No | — | — |
| Example 8 | No | — | — |
| Comparative Example 1 | Yes | 0.69 | 81 |
| Comparative Example 2 | Yes | 0.61 | 83 |
| Comparative Example 3 | Yes | 0.69 | 81 |
| Comparative Example 4 | Yes | 0.59 | 84 |
| Comparative Example 5 | Yes | 0.56 | 84 |
| Comparative Example 6 | Yes | 0.69 | 81 |
| Comparative Example 7 | Yes | 0.57 | 84 |
| Comparative Example 8 | Yes | 0.65 | 82 |
| Comparative Example 9 | Yes | 0.68 | 81 |
| Comparative Example 10 | Yes | 0.74 | 79 |

Evaluation Results

As shown in Table 1, the hot-rolled coil B exhibited recrystallized and coarsened grains in the microstructure after the coiling, due to the excessively high coiling temperature. As a result, in the rolled sheets of Comparative Examples 9 and 10 obtained from the hot-rolled coil B, crystal grains and recrystallized grains after the annealing were coarse as shown in Table 2. Consequently, the edge crack was formed during the cold-rolling before obtaining the target thickness, as shown in Table 3.

Meanwhile as shown in Table 2, in each of the rolled sheets of Comparative Examples 1 to 4 and 6, a percentage area of the recrystallized grains in the microstructure after the annealing was small due to the elevated temperature being too low or the duration of the maintaining being too short, thereby resulting in smaller grain diameters. As a result, ductility of the rolled sheets was insufficient, leading to the generation of the edge crack during the cold-rolling before obtaining the target thickness, as shown in Table 3. Meanwhile as shown in Table 2, in each of the rolled sheets of Comparative Examples 5, 7 and 8, a mean grain diameter of the recrystallized grains in the microstructure after the annealing was small, due to the elevated temperature being too high or the duration of the maintaining being too long. Consequently, the edge crack was formed during the cold-rolling before obtaining the target thickness, as shown in Table 3.

Whereas, with the rolled sheets of Examples 1 to 8, completion of the cold-rolling was enabled without generating the edge crack, due to the elevated temperature, the duration of the maintaining, and the like being appropriately adjusted.

INDUSTRIAL APPLICABILITY

As described in the foregoing, the present invention provides the production method of a rolled sheet for cold-rolling that is capable of reducing the production cost while inhibiting the generation of the edge crack during the cold-rolling. The present invention also provides the production method of a pure titanium sheet that is suited for production of inexpensive and high-quality pure titanium sheets.

The invention claimed is:

1. A method for producing a rolled sheet for cold-rolling, the method consisting of:

hot-rolling a pure titanium material while coiling;

annealing a hot-rolled sheet formed by the hot-rolling; and removing an oxidized layer formed on a surface of the hot-rolled sheet during the hot-rolling and the annealing, wherein:

a coiling temperature in the hot-rolling is less than or equal to 500° C.;

the annealing is performed by raising a temperature of the hot-rolled sheet formed by the hot-rolling to an elevated temperature T ranging from 650° C. to 750° C. and subsequently maintaining the hot-rolled sheet at the elevated temperature T for a duration t satisfying (2), (4), or (5) as follows, depending on the elevated temperature T:

(2) 80 sec $\leq t \leq 160$ sec when 680° C. $\leq T \leq 720$° C., (4) 160 sec $< t \leq 200$ sec when 650° C. $\leq T < 680$° C., and (5) 40 sec $\leq t < 80$ sec when 720° C. $< T \leq 750$° C.; and the annealing is controlled such that a percentage area of recrystallized grains in a microstructure of the hot-rolled sheet after the annealing is greater than or equal to 90%, and that a mean grain diameter of the recrystallized grains is greater than or equal to 6 μm and less than or equal to 10 μm.

2. A method of producing a pure titanium sheet, the method consisting of cold-rolling a rolled sheet obtained by the method of claim 1, without carrying out intermediate annealing.

3. The method of claim 2, wherein a total rolling reduction in the cold-rolling is greater than 85%.

* * * * *